US005669709A

United States Patent [19]

Adams

[11] Patent Number: 5,669,709

[45] Date of Patent: Sep. 23, 1997

[54] DECORATIVE LIGHT HOLDER

[75] Inventor: William E. Adams, Portersville, Pa.

[73] Assignee: Adams Mfg. Corp., Portersville, Pa.

[21] Appl. No.: 585,282

[22] Filed: Jan. 11, 1996

[51] Int. Cl.[6] ..... F21V 21/08

[52] U.S. Cl. ..... 362/396; 362/145; 362/249; 362/432; 362/806

[58] Field of Search ..... 362/249, 396, 362/432, 806, 145, 151, 152; 248/48.1, 74.2, 215, 229.26, 231.81, 300, 301, 304, 316.7, 339

[56] References Cited

U.S. PATENT DOCUMENTS

| | | | |
|---|---|---|---|
| D. 34,263 | 3/1901 | Bailey | D8/395 |
| D. 331,360 | 12/1992 | Adams | D8/373 |
| D. 342,990 | 1/1994 | Gary | D23/365 |
| D. 356,246 | 3/1995 | Adams | D8/395 |
| D. 356,492 | 3/1995 | Adams | D8/395 |
| 1,025,964 | 5/1912 | Costuma | 248/493 |
| 2,018,636 | 10/1935 | Clemence | 202/227 |
| 3,193,229 | 7/1965 | Stock | 248/74.2 |
| 3,540,687 | 11/1970 | Cuva | 248/223.41 |
| 3,578,282 | 5/1971 | Olsen | 362/396 |
| 3,861,632 | 1/1975 | Siilats | 362/432 |
| 5,141,192 | 8/1992 | Adams | 248/231.81 |
| 5,496,005 | 3/1996 | Dieringer | 248/48.1 |
| 5,531,411 | 7/1996 | Adams | 362/396 |
| 5,566,058 | 10/1996 | Protz, Jr. | 362/396 |

*Primary Examiner*—Alan Cariaso
*Attorney, Agent, or Firm*—Buchanan Ingersoll, P.C.

[57] ABSTRACT

A light holder for mounting a decorative light is provided. The light holder in accordance with the present invention may include a base member and a light support. The base member and light support are preferably formed of extruded plastic. The base member preferably has a first end which forms a hook portion adapted to be attachable to a gutter and a second end adapted to be insertable between overlapping shingles of a roof. The light support is configured to hold a decorative light and may include an attaching member to secure the light support to the base member.

21 Claims, 5 Drawing Sheets

DECORATIVE LIGHT HOLDER

BACKGROUND OF THE INVENTION

1. Field of the Invention

This invention relates to decorative light holders, and more particularly to light holders which are attachable to gutters, shakes, tiles and shingles to support a decorative light.

2. Description of the Prior Art

Festive decorating has been a favorite pastime for many years. Many decorations, such as ornamental or decorative lights, are hung on the gutters and shingles of a house. These decorations are usually hung for only a few weeks during the course of the year.

Numerous conventional devices exist for hanging string decorations and ornamental or decorative lights. Such devices include nails, staples, screw-in hooks, suction cups, and clips which fit over gutters or between shingles or siding. However, it is not uncommon for the decorations or lights to fall from some of the conventional devices during heavy wind.

Many people hang ornamental lights from the gutters of a house to outline the house. Unfortunately, many of the conventional curved or shaped hooks found on many decorative light sockets are not particularly adaptable for use on a gutter.

Other conventional decorative light fasteners securely attach ornamental lights to a gutter, but these conventional fasteners are usually tensioned onto the lip of a gutter. Therefore, one must generally use a ladder to attach the conventional decorative light fasteners to the gutter and may not hang the lights from the ground.

Other conventional decorative light fasteners provide little flexibility inasmuch as they may be only utilized in a single specifically defined manner. See, for example, the decorative light holders disclosed in U.S. Pat. Nos. 3,193,229 and 5,141,192 which are primarily limited to use with a gutter, and U.S. Design Pat. No. D331,360 which is primarily limited to use with shingles. It is desirable to have a single decorative light holder which may be utilized to hang decorative lights on gutters, shakes, tiles or shingles to provide increased flexibility.

In addition, the devices taught by U.S. Pat. Nos. 3,193,229, 5,141,192 and D331,360 generally hold the electrical cord connecting the decorative lights and are not adapted to hold the socket of the decorative light. It is preferred to grasp the decorative light socket to reduce the movement of the light and to hold the lights in a specific orientation to assure that they can be easily seen.

Many of the conventional ornamental light holders are fabricated of plastic to provide an inexpensive and lightweight ornamental light holder. However, such plastic decorative or ornamental light holders are usually made by a relatively slow molding process.

SUMMARY OF THE INVENTION

A light holder for mounting a decorative light is provided. The light holder in accordance with the present invention may include a base member and a light support. The base member and light support are preferably formed simultaneously in a two plate injection mold or by extrusion.

The base member preferably has a first end and a second end. The first end forms a spiral hook portion adapted to be attachable to a gutter of a building. The second end is straight and adapted to be insertable between overlapping shingles, shakes or tiles of a building, between cracks in siding, where siding meets trim at windows, on corners, or soffit and fascia.

The base member may additionally include a boss on one surface thereof. The boss may have a hole to accept a rod for hanging the decorative light holder and an ornamental light therein.

The light support preferably has at least one arm and an attaching member. The arms are preferably sized and configured to engage and hold a base of the decorative light. The light support may additionally include a plurality of arms to securely hold decorative lights having different sizes. The attaching member is configured to secure the light support to the base member. Other shapes that securely grip decorative lights may also be used.

The light support and the base member may have the same width, thereby being able to be extruded when the light support is nested above the straight portion during manufacture.

A complete understanding of the invention will be obtained from the following description and the accompanying figures.

DETAILED DESCRIPTION OF THE PREFERRED EMBODIMENTS

Figure 1:
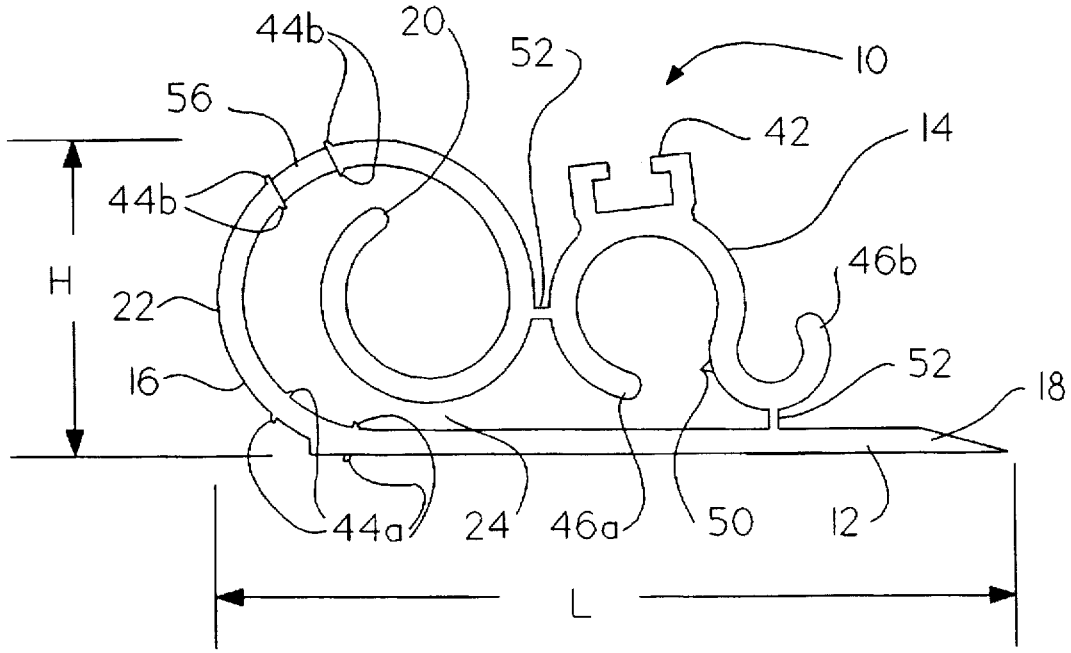
FIG. 1 is a side view of a first embodiment of the decorative light holder in accordance with the present invention wherein the light support is nested above the straight end of the base member.

Referring to FIG. 1, the base member 12 may preferably be utilized to attach the light holder 10 to a gutter 36 or between overlapping shingles of a building. The light support 14 holds the ornamental or decorative light 32 and preferably includes an attaching member 42 for attachment to the base member 12.

The base member 12 includes a first end 16 and a second end 18. The first end 16 has a hook portion 22 configured to be attachable to a gutter 36 of a dwelling or other building. As shown in FIG. 1, the hook portion 22 is preferably a spiral curvature which has a proximal point 20 at some point on the spiral curvature.

The proximal point 20 is adjacent the base member 12 and preferably defines a space 24 therebetween. The space 24 is provided to accept a lip 34 of a gutter 36 during the attachment of the light holder 10 thereto as shown in FIG. 7 through FIG. 10. Space 24 may expand to accept a tile or shingle.

The second end 18 of the base member 12 is preferably substantially straight. Providing a straight second end 18 permits the base member 12 to be inserted between overlapping shingles on the roof of the building to be decorated. In addition, the second end 18 is preferably tapered to permit easy installation of the light holder 10 between the shingles.

Figure 2:
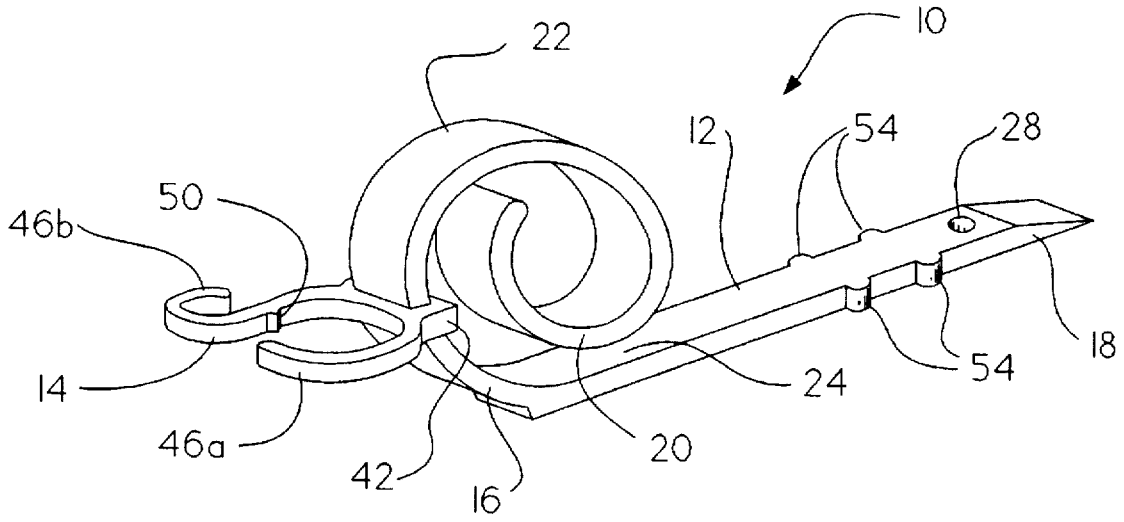
FIG. 2 is a perspective view of the embodiment of the decorative light holder of FIG. 1 in an assembled condition.

The base member 12 and the light support 14 are attachable to one another to form the light holder 10 in accordance with the present invention. Referring to FIG. 1, the light support 14 may include an attaching member 42 to secure the light support 14 to the base member 12. The attaching member 42 may be a resilient clamp as shown in FIG. 1. As shown in FIG. 2 the base member 12 fits within the resilient clamp to securely attach the light support 14 to the base member 12. The base member 12 and light support 14 may be separated after use for compact storage and to reduce the likelihood of damage to the light holder 10.

Figure 4:
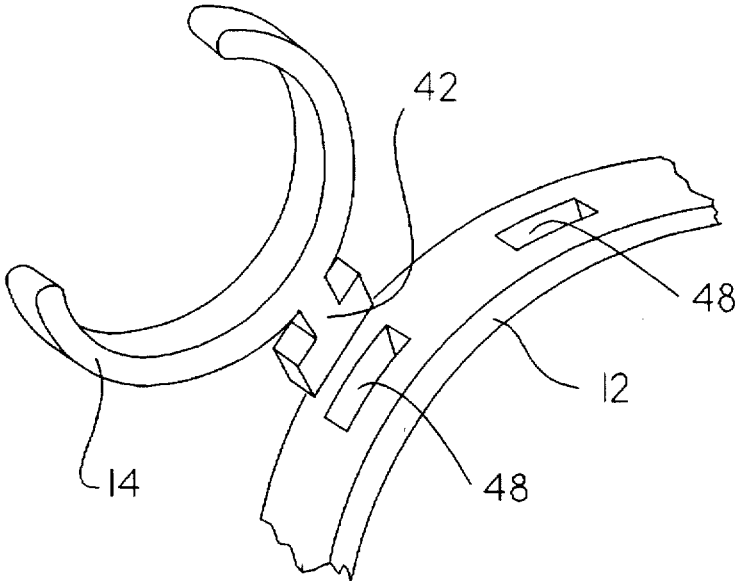
FIG. 4 is a perspective view showing a second embodiment of an attaching member being attached to a modified portion of the base member.

The attaching member 42 may alternatively be formed as a protrusion which may be insertable into the base member 12. As shown in FIG. 4, the base member 12 may be modified to include an orifice 48 for accepting the attaching member 42. The protrusion may be inserted into the orifice 48 and the light support 14 may be rotated to lock the light support 14 and the base member 12 together.

Figure 6:
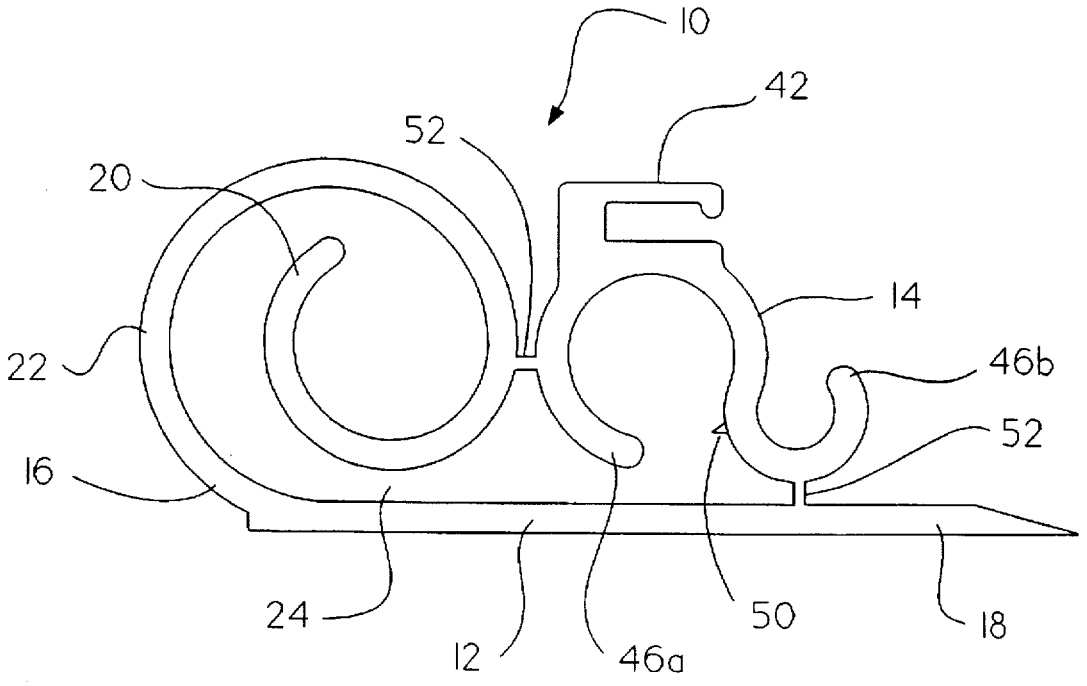
FIG. 6 is a side view, similar to FIG. 1, of a third embodiment of the decorative light holder.

Referring to FIG. 6, an alternate attaching member 42 is shown attached to the light support 14 of the third embodiment of the decorative light holder 10. This attaching member 42 is similar to the one shown in FIG. 1 and may be removably clamped onto the base member 12 for removably connecting the light support 14 thereto.

The base member 12 may include a plurality of protrusions **44*a*, 44*b* preferably located on an outer edge and inner edge of the spiral curvature as shown in FIG. 1. The attaching member 42 of the light support 14 is placed intermediate the first protrusions 44*a* or second protrusions 44*b* to maintain the light support 14 in a fixed position relative to the base member 12**.

The light support 14 may be placed in any orientation on the base member 12 to maximize the amount of light emitted from the decorative light 32 which reaches an observer. Then, the lights are more easily seen. In particular, the light support 14 may be placed intermediate the first protrusions **44*a* if the light holder 10 will be attached to a gutter 36. Alternatively, the light support 14 may be attached to the base member 12 intermediate the second protrusions 44*b* if the light holder 10 will be placed between shingles of the building. Specifically, the decorative light 32** should be positioned in a vertical orientation to maximize the amount of visible light.

Referring to FIG. 1, the light holder 10 may include at least one notch 56 within the base member 12 to facilitate the attachment of the attaching member 42 thereto. Notches 56 may additionally be utilized to maintain the light support 14 in a fixed position relative to the base member 12.

Webbing 52 may be utilized to connect the base member 12 with the light support 14 as shown in FIG. 1 and FIG. 6. It is preferred to attach the base member 12 and light support 14 as shown in FIG. 1 to reduce the size of the light holder 10 for compactness during shipping. The web 52 also assures that the base and light support are always packed together and not sold separately.

The webbing 52 may be easily broken and the base member 12 and light support 14 separated from one another when the light support 14 is to be put into use.

The light support 14 is preferably formed of polypropylene or polycarbonate but could be made of metal or other plastics. The light support 14 is preferably resilient to provide flexibility when the decorative light 32 is inserted into and removed from the light support 14 and to enable the light support 14 to securely grasp the decorative light 32. The light holder 10 may have a width of approximately ¼", and total length of approximately 2⅝" and total height of approximately 1³⁄₁₆", represented by L and H, respectively, in FIG. 1.

The light support 14 is preferably an arcuate member and may specifically include a pair of arms **46*a*, 46*b* connected together adjacent the attaching member 42 at one of their ends and spaced apart at their other ends. The arms 46*a*, 46*b* may be sized and shaped to define an opening smaller than the diameter of a socket of a first decorative light 32 and sufficiently flexible to define an opening larger than a diameter of a socket of a second, larger decorative light 32. The arms 46*a*, 46*b* are preferably adapted to hold the first decorative light and the second decorative light when the socket of either one of the decorative lights is placed between the arms 46*a*, 46*b***.

The light support 14 may be a U-shaped member as shown in FIG. 4. Alternative configurations of the light support 14 are additionally encompassed within the scope of the light holder 10 in accordance with the present invention.

The light support 14 shown in FIG. 1 is preferred inasmuch as it may be utilized to grasp decorative lights 32 having various sizes. Referring to FIG. 1, the light support 14 may additionally include a knob 50 on the second arm **46*b* for restraining a decorative light 32 within the light support 14**.

Figure 5:
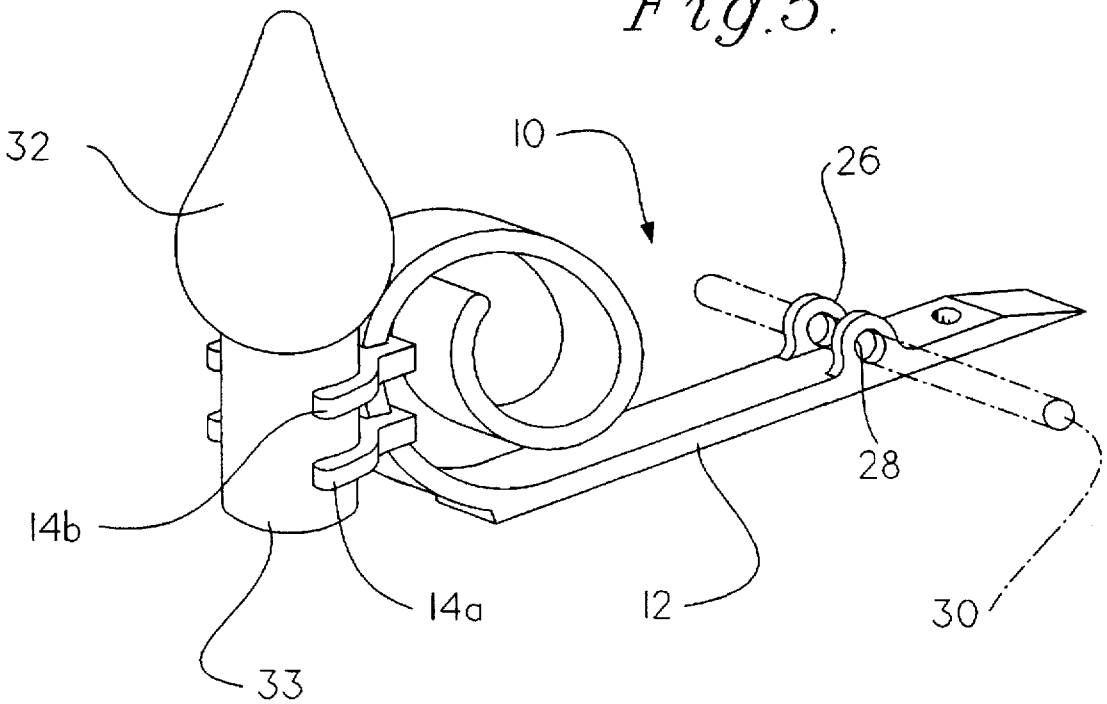
FIG. 5 is a perspective view of the second embodiment of the attaching member.
Figure 7:
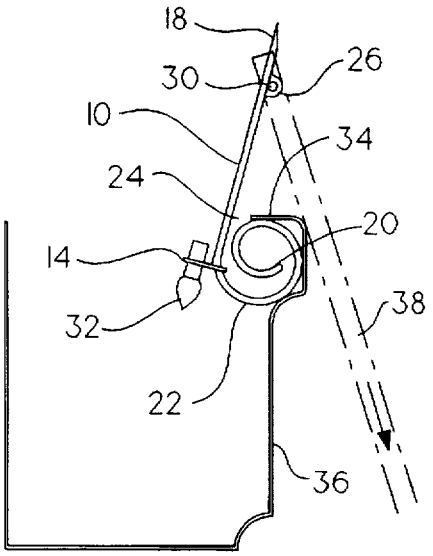
FIGS. 7 through 10 show a diagrammatic progression of the mounting of the light holder in accordance with the present invention on a gutter.
Figure 8:
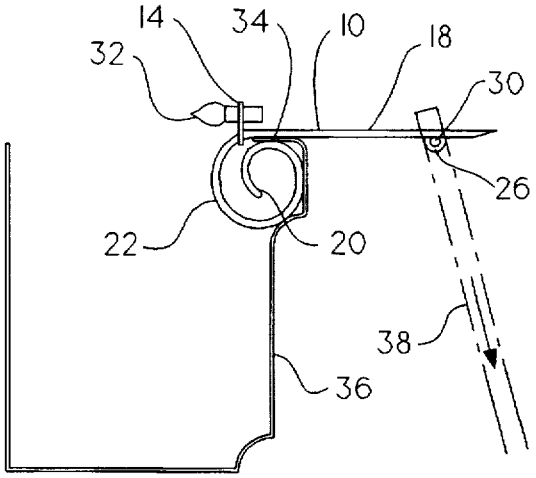
Figure 9:
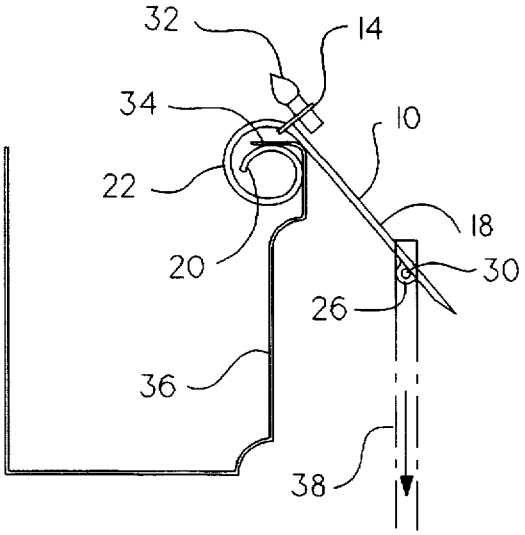
Figure 10:
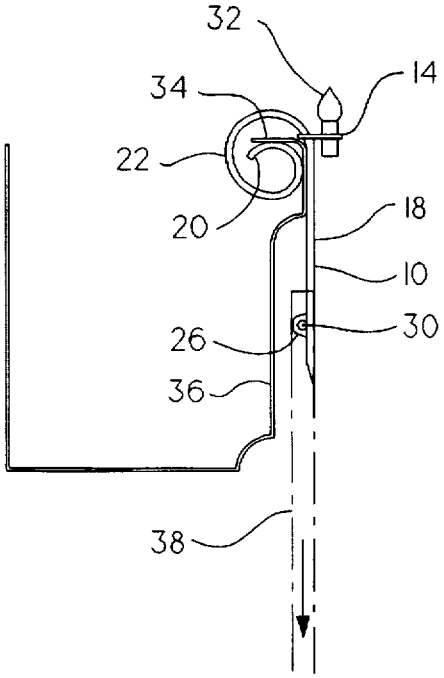

A single arcuate member light support 14 is shown in FIG. 4. The light holder 10 may include different size light supports 14 for holding decorative lights 32 of different sizes. FIG. 5 shows two U-shaped light supports 14 attached to the base member 12 to securely grasp larger sized decorative lights 32.

The opening in the light support 14 may additionally be increased to hold decorative lights 32 having larger diameters.

The light holder 10 may include a boss 26 as shown in FIG. 5. In particular, a boss 26 having a hole 28 therethrough may be attached to the base member 12. A boss 26 having the hole 28 may accept a rod 30 which is attached to an elongated shaft 38. A user standing on the ground may utilize the elongated shaft 38 and rod 30 to mount the light holder on a gutter 36 as shown in FIG. 7 through FIG. 10.

Alternatively, the hole 28 for accepting the rod 30 may pass through the upper surface of the base member 12 to the lower surface thereof as shown in FIG. 2 thereby permitting the base member 12 to be slidable under shingles.

Referring to FIG. 7 through FIG. 10, a method of suspending the device from a gutter 36 is shown. The light holder 10 is placed upon the rod 30 and suspended over and inside a lip 34 of the gutter 36. The light holder 10 is subsequently lowered into the gutter 36 and brought forward such that the spiral curvature is brought into contact with the inside face of the lip 34 of the gutter 36. The light holder 10 is positioned so that the lip 34 fits into the space 24 defined by the spiral curvature and the base member 12.

The light holder 10 may be subsequently rotated around the rod 30 by moving the elongated shaft 38 downwards while maintaining contact between the spiral curvature and the inside face of the gutter 36 and the lip 34 thereof. The lip 34 slides into the space 24 and distorts the spiral curvature which then grips the lip 34 and the outer surface of the gutter 36.

The edge of the lip 34 of the gutter 36 is fully inserted into the space 24 when the device is fully rotated. A pull on the elongated shaft 38 firmly mounts the light holder 10 on the lip 34 of the gutter 36 by pinching the gutter 36 between the base member 12 and the proximal point 20.

The lip 34 of the gutter 36 is thereby encompassed within the spiral section of the first end 16 of the base member 12. The rod 30 and elongated shaft 38 may thereafter be removed from the base member 12 by sliding the rod 30 out of the hole 28.

Removal of the light holder 10 from the gutter 36 may be accomplished by merely reversing the steps previously described. Specifically, the rod 30 may be inserted into the hole 28 within the boss 26 and the light holder 10 may be rotated off of the lip 34 of the gutter 36. The light holder 10 may thereafter be lowered to a reachable height.

In addition, the second end 18 of the base member 12 may include ridges 54 as shown in FIG. 2. The ridges 54 may be gripped by a forked or slotted attachment positioned on the end of an elongated pole (not shown) for facilitating the placement and removal of the decorative light holder 10.

Figure 3:
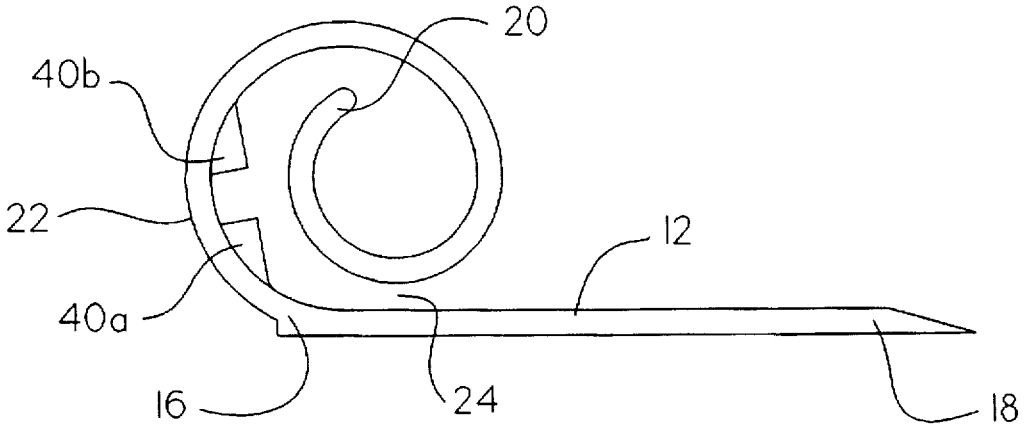
FIG. 3 is a side view of a second embodiment of the base member.

Referring to FIG. 3, ramps 40*a*, 40*b* may be provided on the inner surface of the hook portion 22 to assist with the rotation of the spiral curvature over the lip 34 of the gutter 36. The ramps 40*a*, 40*b* may be configured to lock onto the edge of the gutter 36 to permit secure attachment of the light holder 10.

The base member 12 and the light support 14 of the light holder 10 are preferably configured such that both the base member 12 and the light support 14 may be fabricated from a plastic extrusion process.

Figure 11:
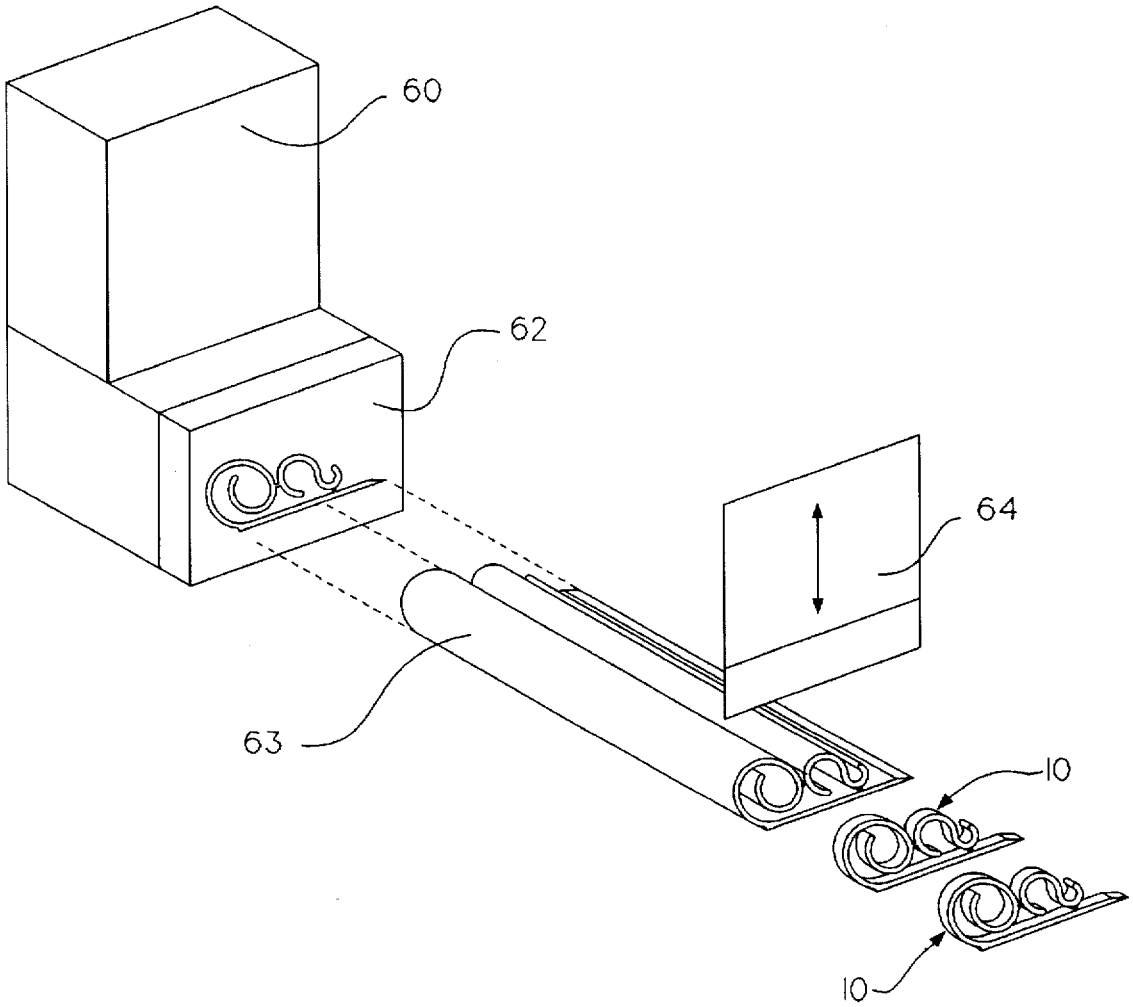
FIG. 11 is schematic representation of an extrusion process which may be utilized to fabricate the decorative light holder of FIG. 1.

Referring to FIG. 11, an open end of an extruder 60 is coupled with a die 62. The extruder 60 forces the plastic therein toward the open end thereof. The die may be configured to form one of the base member 12, the light support 14 or both the base member 12 and the light support 14 as shown in FIG. 11.

The plastic is forced through the die 62 to form a shaped plastic preform 63. The plastic preform 63 is cut by a slicer 64 to produce a plurality of light holders 10 as shown. A punch may simultaneously or subsequently be utilized to form a hole 28 or an orifice 48 within the base member 12.

Alternatively, the decorative light holder 10 may be fabricated from a molding process. The light support 14 of the light holder 10 may be formed to be either thinner or thicker than the base member 12, depending upon the size of the socket of the decorative light 32 to be held.

While preferred embodiments of the invention have been shown and described herein, it will be appreciated by those skilled in the art that various modifications and alternatives to the disclosed embodiments may be developed in light of the overall teachings of the disclosure. Accordingly, the disclosed embodiments are meant to be illustrative only and not limiting to the scope of the invention which is to be given the full breadth of the following claims and all equivalents thereof.

I claim:

1. A light holder for mounting a decorative light, the light holder comprising:

a. a base member having a first end and a second end;
the first end forming a hook portion having spiral curvature with a proximal point adjacent said base member and being sized and shaped to be attachable to a gutter and the second end being sized and shaped to be insertable between overlapping shingles; and b. a light support being separable from said base member and having at least one arm and an attaching member;
the at least one arm being sized and configured to engage and hold a socket of the decorative light and the attaching member being adapted to secure said light support to said base member at a position thereon.

2. The light holder of claim 1 wherein said base member and said light support are formed of extruded plastic.

3. The light holder of claim 1 wherein the hook portion is a spiral curvature with a proximal point adjacent said base member and the hook portion is adapted to fit over a portion of a gutter lip passed between the proximal point and said base member.

4. The light holder of claim 3 wherein said base member and said light support are formed of extruded plastic.

5. The light holder of claim 1 wherein the second end of said base member is substantially straight.

6. The light holder of claim 5 wherein said base member and said light support are formed of extruded plastic.

7. The light holder of claim 1 wherein said light support includes a pair of arms connected together adjacent the attaching member at one of their ends and spaced apart at their other ends, the arms sized and shaped to define an opening smaller than a diameter of a socket of a first decorative light and sufficiently flexible to define an opening larger than a diameter of a socket of a second, larger decorative light, and to hold one of the first decorative light and the second decorative light when one of the sockets of the decorative lights are placed between the arms.

8. The light holder of claim 7 wherein the hook portion is a spiral curvature with a proximal point adjacent said base member and the hook portion is adapted to fit over a portion of a gutter lip passed between the proximal point and said base member.

9. The light holder of claim 8 wherein said base member and said light support are formed of extruded plastic.

10. The light holder of claim 1 further comprising a boss attached to said base member and having a hole therethrough.

11. The light holder of claim 10 wherein the hook portion is a spiral curvature with a proximal point adjacent said base member and the hook portion is adapted to fit over a portion of a gutter lip passed between the proximal point and said base member.

12. The light holder of claim 11 wherein said base member and said light support are formed of extruded plastic.

13. The light holder of claim 1 wherein said base member includes at least one ramp adjacent the hook portion.

14. A light holder for mounting a decorative light, the light holder comprising:

a. a base member having a first end and a second end;
the first end forming a hook portion which includes a spiral curvature having a proximal point adjacent said base member and the hook portion being adapted to fit over a gutter lip passed between the proximal point and said base member; and b. a light support having at least one arm and an attaching member;
the at least one arm being sized and configured to engage and hold a socket of the decorative light and the attaching member being adapted to secure said light support to said base member at a position thereon.

15. The light holder of claim 14 wherein said base member and said light support are formed of extruded plastic.

16. The light holder of claim 14 wherein said light support includes a pair of arms connected together adjacent the attaching member at one of their ends and spaced apart at their other ends, the arms sized and shaped to define an opening smaller than a diameter of a socket of a first decorative light and sufficiently flexible to define an opening larger than a diameter of a socket of a second, larger decorative light, and to hold one of the first decorative light and the second decorative light when one of the sockets of the decorative lights are placed between the arms.

17. The light holder of claim 16 wherein said base member and said light support are formed of extruded plastic.

18. The light holder of claim 14 further comprising a boss attached to said base member and having a hole therethrough.

19. The light holder of claim 14 wherein said base member and said light support are removably attachable.

20. The light holder of claim 14 wherein said base member includes at least one ramp adjacent the hook portion.

21. A light holder for mounting a decorative light, the light holder comprising:

a. an extruded plastic base member having a first end and a second end;

the first end forming a hook portion which includes a spiral curvature having a proximal point adjacent said base member and the hook portion being adapted to fit over a gutter lip passed between the proximal point and said base member and the second end being adapted to be insertable between overlapping shingles; and b. an extruded plastic light support having an attaching member to secure said light support to said base member at a position thereon;

the light support includes a pair of arms connected together adjacent the attaching member at one of their ends and spaced apart at their other ends, the arms sized and shaped to define an opening smaller than a diameter of a socket of a first decorative light and sufficiently flexible to define an opening larger than a diameter of a socket of a second, larger decorative light, and to hold one of the first decorative light and the second decorative light when one of the sockets of the decorative lights are placed between the arms.

* * * * *